US008000492B2

(12) United States Patent
Kao et al.

(10) Patent No.: US 8,000,492 B2
(45) Date of Patent: Aug. 16, 2011

(54) EARPHONE SET

(75) Inventors: Kuo Jung Kao, Taipei (TW); Shih Chieh Wei, Taipei (TW)

(73) Assignee: Giga-Byte Technology, Hsin-Tien Dist., New Taipei (TW)

( * ) Notice: Subject to any disclaimer, the term of this patent is extended or adjusted under 35 U.S.C. 154(b) by 1226 days.

(21) Appl. No.: 11/703,121

(22) Filed: Feb. 7, 2007

(65) Prior Publication Data

US 2008/0187165 A1 Aug. 7, 2008

(51) Int. Cl.
*H04R 25/00* (2006.01)

(52) U.S. Cl. ..... 381/381; 381/370

(58) Field of Classification Search ..... 381/330, 381/370–371, 374, 381; 379/430
See application file for complete search history.

(56) References Cited

U.S. PATENT DOCUMENTS

| | | | | |
|---|---|---|---|---|
| 3,735,021 | A * | 5/1973 | Bonis et al. | 174/86 |
| 6,047,076 | A * | 4/2000 | Yang | 381/381 |
| 6,233,344 | B1 * | 5/2001 | Clegg et al. | 381/381 |
| 7,082,207 | B2 * | 7/2006 | Rapps | 381/381 |
| 7,231,056 | B2 * | 6/2007 | Chen | 381/381 |

* cited by examiner

*Primary Examiner* — Suhan Ni
(74) *Attorney, Agent, or Firm* — Ming Chun Chou

(57) ABSTRACT

An earphone set includes an earphone and a hanger. The earphone includes a shell and a shaft extending from the shaft. The hanger includes a bushing, a connector and a hook. The bushing is mounted on the shaft. The connector includes an annular portion mounted on the bushing. The bushing cannot be rotated in the annular portion just because of a torque derived from the weight of the earphone. However, when additionally subjected to a proper torque, the bushing can be rotated in the annular portion. The hook is rotationally connected to the connector.

8 Claims, 2 Drawing Sheets

EARPHONE SET

BACKGROUND OF INVENTION

1. Field of Invention

The present invention relates to an earphone set and, more particularly, to an earphone set including an earphone and a hanger capable of rotation about two axes for properly hanging the earphone on a user's ear.

2. Related Prior Art

Mobile phones are popular tools for wireless communication. A user holds a mobile phone close to an ear while using the mobile phone. A user may however wish to keep the mobile phone from the head while using the mobile phone for safety and health. To this end, the user uses a headset together with the mobile phone. The headset includes an earphone and a microphone. The user holds the earphone near an ear and the microphone near the mouth.

In early days, a headset is connected to a mobile phone via a wire. For being miniature and light, an earphone of the headset is disposed in an ear. The wire however often gets tangled with objects and causes trouble for a user.

To avoid the foregoing drawback, wireless headsets have been devised. A wireless headset includes an earphone, a microphone, a transceiver and a shell for containing the earphone, the microphone and the transceiver. The headset is large and heavy and therefore needs a hanger for hanging on an ear.

A conventional hanger is only adapted for hanging on a specific one of a user's ears and generally the left ear.

As disclosed in Taiwanese Patent Publication Nos. 519363 and 465894, a headset includes an earphone, a microphone, a shell for containing the earphone and the microphone and a hanger connected to the shell. The hanger can be twisted so that it can be used for hanging the shell on either one of a user's ears. It is however hard to locate the earphone properly close to any user's ear since the shell cannot be rotated with respect to the hanger.

As disclosed in Taiwanese Patent M257589, a headset includes an earphone, a microphone, a shell for containing the earphone and the microphone and a hanger connected to the shell. The hanger can be twisted so that it can be used for hanging the shell on either one of a user's ears. The shell can be rotated and resiliently held in a desired one of several angular positions with respect to the hanger so that the microphone can be located close to any user's mouth. The shell however cannot be located in any desired angular position with respect to the hanger.

The present invention is therefore intended to obviate or at least alleviate the problems encountered in prior art.

SUMMARY OF INVENTION

The primary objective of the present invention is to provide an earphone set including an earphone and a hanger capable of rotation about two axes for properly hanging the earphone on a user's ear.

According to the present invention, an earphone set includes an earphone and a hanger. The earphone includes a shell and a shaft extending from the shaft. The hanger includes a bushing, a connector and a hook. The bushing is mounted on the shaft. The connector includes an annular portion mounted on the bushing. The bushing cannot be rotated in the annular portion just because of a torque derived from the weight of the earphone. However, when additionally subjected to a proper torque, the bushing can be rotated in the annular portion. The hook is rotationally connected to the connector.

Other objectives, advantages and features of the present invention will become apparent from the following description referring to the attached drawings.

BRIEF DESCRIPTION OF DRAWINGS

The present invention will be described through detailed illustration of the preferred embodiment referring to the drawings.

DETAILED DESCRIPTION OF PREFERRED EMBODIMENT

Figure 1:
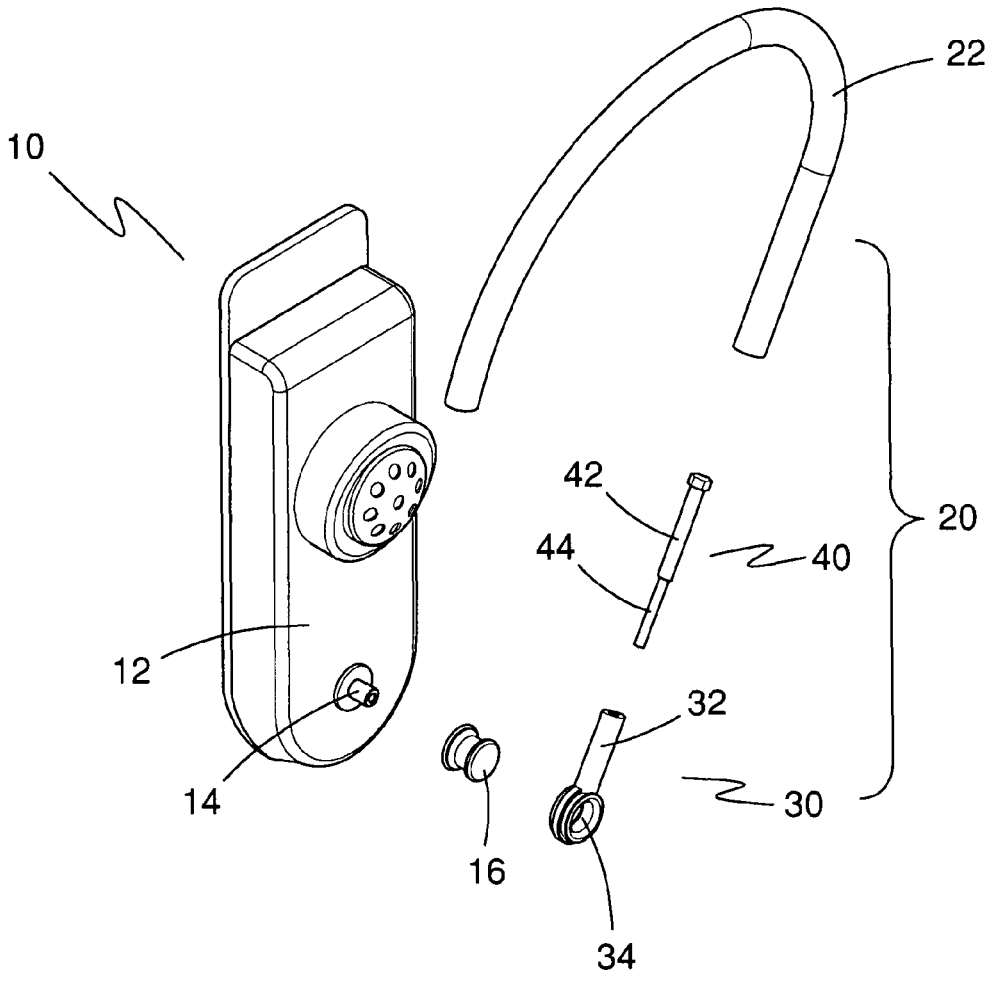
FIG. 1 is an exploded view of an earphone set according to the preferred embodiment of the present invention.
Figure 2:
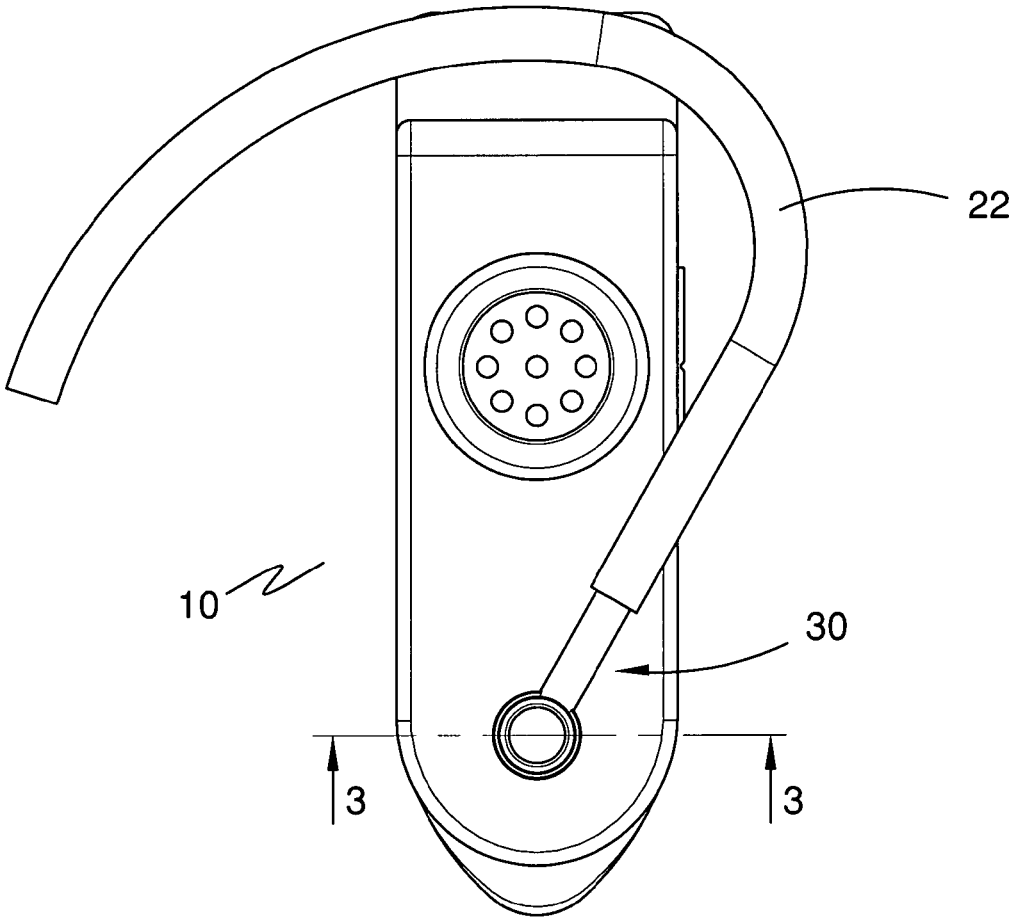
FIG. 2 is a side view of the earphone set shown in FIG. 1.
Figure 3:
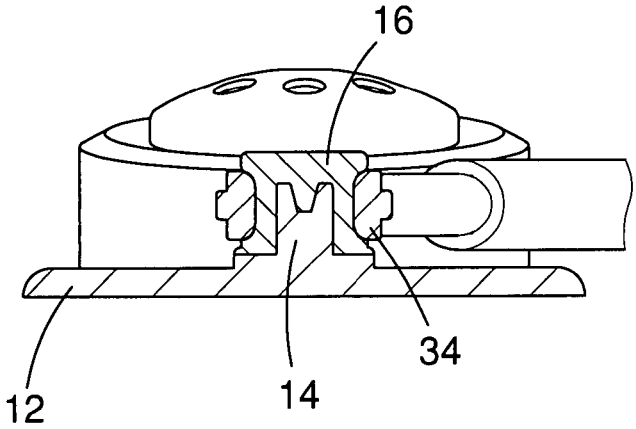
FIG. 3 is a cross-sectional view of the earphone set taken along a line 3-3 shown in FIG. 2.

Referring to FIGS. 1 through 3, according to the preferred embodiment of the present invention, an earphone set includes an earphone 10 and a hanger 20 capable of rotation about two axes for properly hanging the earphone 10 on a user's ear.

The earphone 10 includes a shell 12 and a shaft 14 extending from the shell 12. The shell 12 and the shaft 14 are generally made of plastic. The shell 12 and the shaft 14 are preferably made as one.

The hanger 20 includes a bushing 16, a connector 30, a rotational unit 40 and a hook 22.

The bushing 16 is mounted on the shaft 14. Adhesive may be provided between the bushing 16 and the shaft 14 so that they are firmly joined together. The bushing 16 is preferably made of rubber.

The connector 30 includes an annular portion 34 and a tubular portion 32 extending from the annular portion 34. The annular portion 34 is mounted on the bushing 16. The connector 30 is generally made of plastic. There is proper friction between the annular portion 34 and the bushing 16. The annular portion 34 cannot be rotated on the bushing 16 just because of a torque derived from the weight of the earphone 10. However, when additionally subjected to a proper torque, the annular portion 34 can be rotated on the bushing 16. Therefore, the annular portion 34 can be moved to and resiliently held in any desired annular portion with respect to the bushing 14.

The rotational unit 40 includes a tube 42 and a mandrel 44 partially inserted in the tube 42. The mandrel 44 is partially inserted in the tubular portion 32. The mandrel 44 can be resiliently kept in a selected one of several angular positions on the tube 44. The rotational unit 40 is preferably made of metal. The tube 42 is fit in a tubular portion of the hanger 22.

As best seen, the rotational unit 40 is hidden in the hanger 22 and the connector 30. The rotation unit 40 enables the rotation of the hanger 22 with respect to the connector 30 and the resilient holding of the hanger 22 in a selected one of the angular positions on the connector 30.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. An earphone set comprising:

an earphone comprising a shell and a shaft extending from the shaft; and a hanger comprising:

a bushing mounted on the shaft;

a connector comprising an annular portion mounted on the bushing so that the bushing cannot be rotated in the annular portion just because of a torque derived from the weight of the earphone but can be rotated in the annular portion when additionally subjected to a proper torque; and a hook rotationally connected to the connector.

2. The earphone set according to claim 1 wherein the bushing is made of rubber.

3. The earphone set according to claim 1 comprising a rotational unit for rotationally connecting the earphone to the connector.

4. The earphone set according to claim 3 wherein the rotational unit comprises a tube and a mandrel partially and rotationally inserted in the tube.

5. The earphone set according to claim 4 wherein the tube is connected to the hook.

6. The earphone set according to claim 4 wherein the mandrel is connected to the connector.

7. The earphone set according to claim 6 wherein the connector comprises a tubular portion extending from the annular portion, and the mandrel is fit in the tubular portion.

8. The earphone set according to claim 4 wherein both of the tube and the mandrel are made of metal.

* * * * *